US010696444B2

(12) United States Patent
Dorminey et al.

(10) Patent No.: US 10,696,444 B2
(45) Date of Patent: Jun. 30, 2020

(54) CONTAINER WITH WINDOW DISPLAY PANEL

(71) Applicant: Georgia-Pacific Corrugated LLC, Atlanta, GA (US)

(72) Inventors: Bryan Keith Dorminey, Lawrenceville, GA (US); Okebola Okerinde, Alpharetta, GA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 0 days.

(21) Appl. No.: 16/205,991

(22) Filed: Nov. 30, 2018

(65) Prior Publication Data

US 2019/0168907 A1 Jun. 6, 2019

Related U.S. Application Data

(60) Provisional application No. 62/593,481, filed on Dec. 1, 2017.

(51) Int. Cl.
*B65D 5/42* (2006.01)
*B65D 5/00* (2006.01)
*B65D 5/24* (2006.01)

(52) U.S. Cl.
CPC ..... *B65D 5/4204* (2013.01); *B65D 5/0025* (2013.01); *B65D 5/24* (2013.01)

(58) Field of Classification Search
CPC ..... B65D 5/20–2009; B65D 5/443; B65D 5/001; B65D 5/002; B65D 5/4608
USPC .... 229/162.1, 242, 918, 179, 191, 915, 919, 229/122, 164
See application file for complete search history.

(56) References Cited

U.S. PATENT DOCUMENTS

| | | | |
|---|---|---|---|
| 4,974,772 | A | 12/1990 | Spurrell et al. |
| 5,160,083 | A | 11/1992 | Lafreniere |
| 6,257,484 | B1 | 7/2001 | Dowd |
| 8,596,519 | B2 | 12/2013 | McClure |
| 8,998,074 | B2 | 4/2015 | Schomisch |
| 9,061,791 | B2 | 6/2015 | Cameron |

(Continued)

FOREIGN PATENT DOCUMENTS

WO 2017037624 A1 3/2017

OTHER PUBLICATIONS

European Search Report dated May 16, 2019, in European patent application No. 18209922.6.

*Primary Examiner* — Nathan J Newhouse
*Assistant Examiner* — Phillip D Schmidt

(57) ABSTRACT

A container includes a plurality of panels integrally arranged with respect to each other and with respect to a set of orthogonal x, y and z axes, the plurality of panels being foldable to create the container. The plurality of panels include a first panel disposed parallel to the z-axis, the first panel having a first side portion, a second side portion, and a display portion disposed between the first and second side portions, the first and second side portions and the display portion being coplanar and bordering at least a portion of a product display opening. The first panel further includes a first relief feature disposed between the display portion and the first side portion, and a second relief feature disposed between the display portion and the second side portion, wherein the at least a portion of the product display opening and the first and second relief features are formed by an absence of material of the first panel.

46 Claims, 9 Drawing Sheets

(56) References Cited

U.S. PATENT DOCUMENTS

| | | | | |
|---|---|---|---|---|
| 9,205,948 | B1 | 12/2015 | Block | |
| 9,573,722 | B1 | 2/2017 | Capogrosso | |
| 10,259,611 | B2 * | 4/2019 | Grace | B65D 71/34 |
| 2002/0043554 | A1 * | 4/2002 | White | A47F 5/112 229/235 |
| 2004/0007614 | A1 * | 1/2004 | Saulas | B65D 5/443 229/232 |
| 2005/0045706 | A1 * | 3/2005 | Varanasi | B65D 5/0281 229/240 |
| 2005/0184139 | A1 | 8/2005 | Gasior | |
| 2006/0038000 | A1 | 2/2006 | Sheffer | |
| 2006/0113215 | A1 | 6/2006 | Clements | |
| 2007/0000984 | A1 * | 1/2007 | McClure | B65D 5/443 229/143 |
| 2007/0029220 | A1 * | 2/2007 | Bradford | B25J 7/00 206/427 |
| 2013/0319963 | A1 | 12/2013 | Coon | |
| 2014/0042216 | A1 * | 2/2014 | Cameron | B65D 5/443 229/240 |
| 2016/0083159 | A1 * | 3/2016 | Ramsuer | B65D 71/36 229/242 |
| 2017/0001752 | A1 * | 1/2017 | Ishikawa | B65B 43/265 |
| 2017/0217629 | A1 | 8/2017 | Buscema | |

* cited by examiner

CONTAINER WITH WINDOW DISPLAY PANEL

BACKGROUND OF THE INVENTION

The subject matter disclosed herein relates to containers, particularly to packing containers, and more particularly to packing containers with a display window having a display portion for presenting branding or marketing information, which when stacked one container on top of another is suitably configured for presenting the branding or marketing information on the display portion having controlled creasing or distortion, if and/or where it may occur.

Packing containers are often formed from a corrugated sheet product material that is cut with a die to form one or more flat blanks or scored and slotted to form a flat blank. The flat blank is folded into a three-dimensional container that may be secured using an arrangement of flaps, adhesive liquids, staples or adhesive tapes.

In use, packing containers may be subjected to considerable forces during shipping, storage, stacking and/or display, and may be stacked one on top of another during display of a product contained therein at a point of sale of the product. Some packing containers are used not only for shipping product, but also for displaying and marketing product at a point of sale. While existing packing containers may be suitable for their intended purpose, the art relating to packing containers would be advanced with the inclusion of a display window having a display portion for presenting branding or marketing information relating to the product for sale, where the display portion, or branding claims panel, does not undergo uncontrolled creasing or distortion when one or more containers are stacked on top of each other at the point of sale of the product.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment includes a container, having a plurality of planar panels integrally arranged with respect to each other and with respect to a set of orthogonal x, y and z axes, the z-axis defining a direction line in which the container is configured to support a stacking load, the plurality of panels being foldable to create the container. The plurality of planar panels include a first panel disposed parallel to the z-axis, the first panel having a first side portion, a second side portion, and a display portion disposed between the first and second side portions, the first and second side portions and the display portion being coplanar and bordering at least a portion of a product display opening. The first panel further includes a first relief feature disposed between the display portion and the first side portion, and a second relief feature disposed between the display portion and the second side portion, wherein the at least a portion of the product display opening and the first and second relief features are formed by an absence of material of the first panel.

An embodiment includes a flat blank having a plurality of planar panels integrally arranged with respect to each other with a plurality of fold lines, score lines, perforated lines, or any combination of fold, score, or perforated lines, disposed therebetween, the plurality of panels being foldable to form the aforementioned container.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Figure 1:
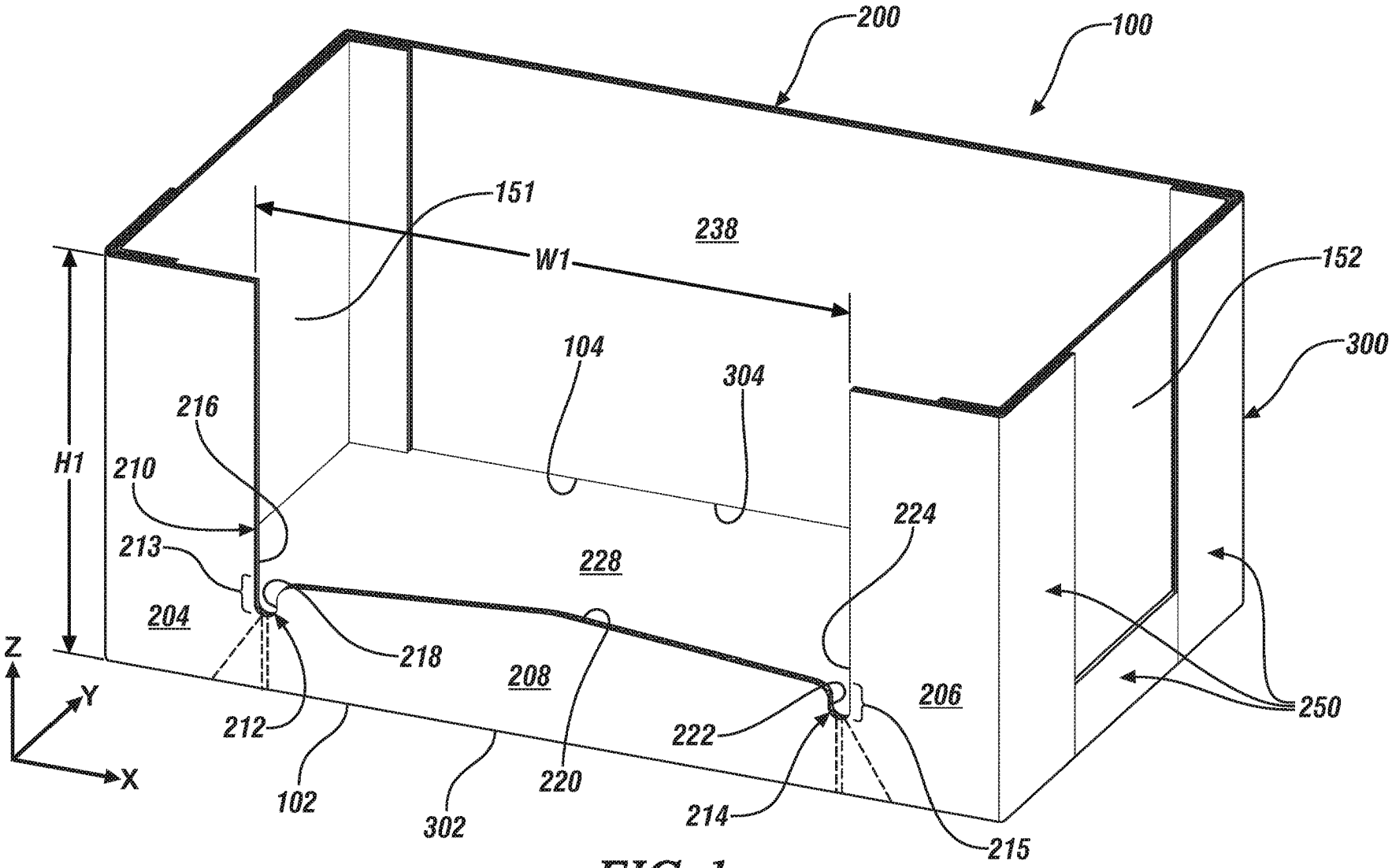
FIG. 1 depicts a rotated isometric view of a container having first and second relief features, in accordance with an embodiment.

Although the following detailed description contains many specifics for the purposes of illustration, a person of ordinary skill in the art will appreciate that many variations and alterations to the following details are within the scope of the claims. Accordingly, the following example embodiments are set forth without any loss of generality to, and without imposing limitations upon, the claimed invention.

A packing container, also referred to as a carton, or simply as a container, may be fabricated by, for example, cutting or scoring a sheet product with a die or other type of cutting or scoring tool, such as cutting, scoring and slotting tooling and equipment, to form a flat sheet having various panels, flaps, tabs, recesses and creases. The sheet may be folded and secured using, for example, liquid or hot melt adhesives, tapes or mechanical means such as staples or straps to form a three-dimensional packing container. Packing containers may be formed from a variety of sheet products. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentangled (sometimes called spunlace), DRC (double re-creped), air laid, spunbond, carded, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Sheet product for packing containers may also include corrugated fiber board, which may be made from a variety of different flute configurations, such as A-flute, B-flute, C-flute, E-flute, F-flute, or micro-flute, for example, as well as multi-wall configurations such as single-wall (A, B or C-flute for example) or double-wall (AC-flutes or BC-flutes for example). In an embodiment, a packing container as disclosed herein may be fabricated from a single piece of corrugated fiber board, or from multiple pieces of corrugated fiber board that are typically assembled by, but not limited to, automated forming equipment. In general, corrugated fiber board useful for a purpose disclosed herein has a thickness, e, referred to as the caliper of the corrugated fiber board, and the flutes of the corrugated fiber board are typically oriented parallel to a stacking load, which is herein below described as the z-direction.

An embodiment, as shown and described by the various figures and accompanying text, provides a product container having a product display window and a branding claims panel (also herein referred to simply as a display portion) for presenting information about the product being displayed and contained within the container. To control creasing or distortion of the display portion of a lower stacked container when one such container is stacked on top of another, engineered features are integrally formed in the container that serve to distribute the compressive load and/or stress away from the display portion, thereby providing a display portion free of or with controlled creases or distortion under load, which presents a more attractive display of product as compared to a creased or distorted display portion.

Figure 2:
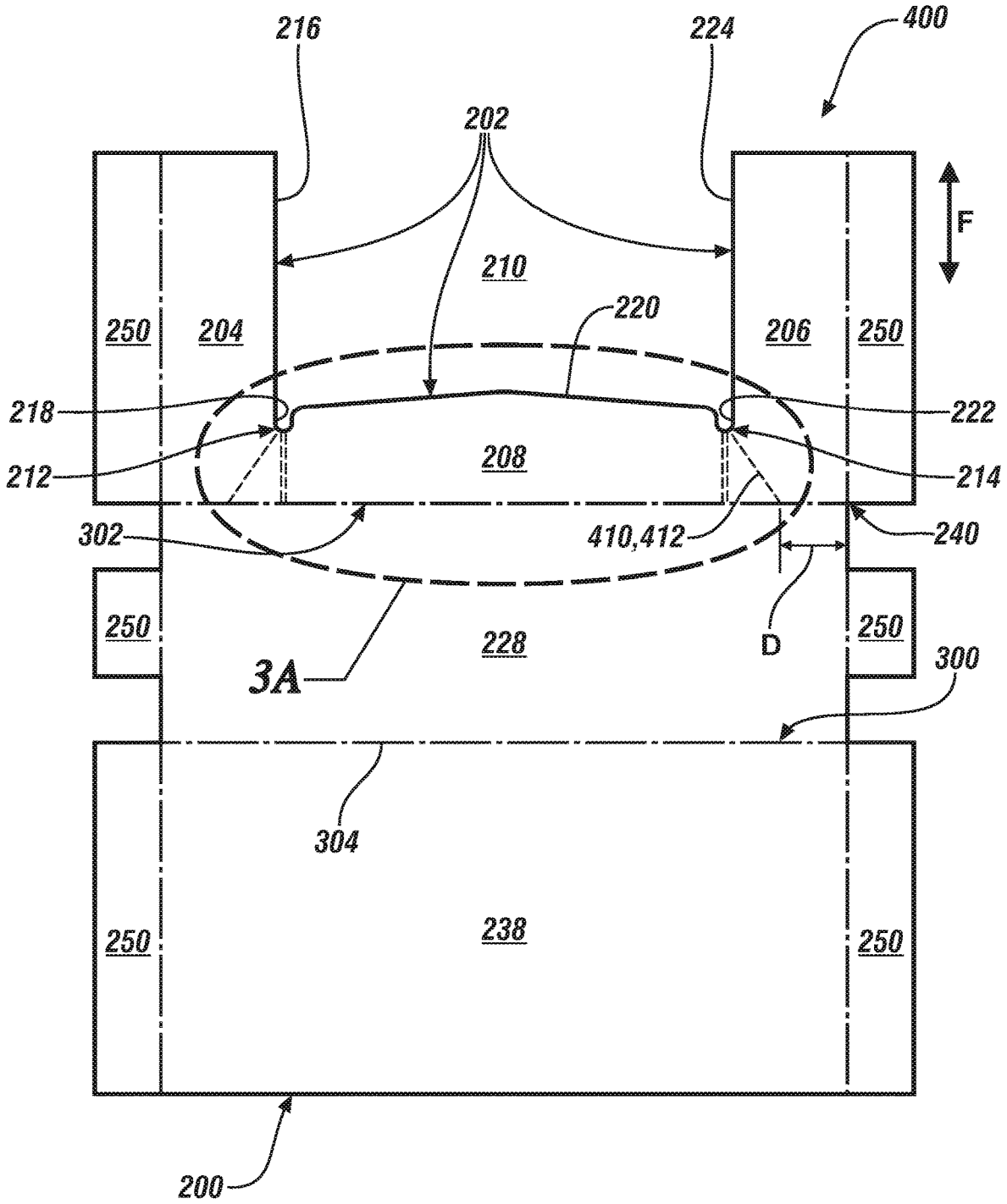
FIG. 2 depicts a flat blank suitable for making at least a portion of the container of FIG. 1, in accordance with an embodiment.

FIG. 1 depicts a rotated isometric view of an example embodiment of a container 100 in accordance with an embodiment disclosed herein, and FIG. 2 depicts a flat blank 400 suitable for forming at least a portion of the container 100 of FIG. 1. Reference will now be made to FIGS. 1 and 2 collectively.

In an embodiment, the container 100 includes a plurality of planar panels 200 integrally arranged with respect to each other, via fold lines, score lines, perforated lines, or any combination thereof, which may be continuous or intermittent, and are enumerated by reference numeral 300, and with respect to a set of orthogonal x, y and z axes, where the z-axis defines a direction line, z-direction, in which the container 100 is configured to support a stacking load, and the plurality of panels 200 are foldable to create at least a portion of the container 100. As will become clearer herein below, the flat blank 400 is configured to have front, bottom and back panels 200 of the container 100, along with corner and bottom edge support/glue flaps 250 that are configured to receive supplemental side panels 151, 152. However, it will be appreciated that other flat blank arrangements may be provided with different panel arrangements while still being consistent with and falling with the scope of the invention disclosed herein.

In an embodiment, the plurality of planar panels 200 include a first panel 202 disposed parallel to the z-axis (when the panels 200 are in a folded state to form the container 100). The first panel 202 includes a first side portion 204, a second side portion 206, and a display portion 208 disposed between the first and second side portions 204, 206. The first and second side portions 204, 206 and the display portion 208 are coplanar with each other and border at least a portion of a product display opening 210 having an overall product display opening width W1, the at least a portion of the product display opening 210 being formed by an absence of material of the first panel 202. In the container 100 depicted in FIG. 1 the first and second side portions 204, 206 and the display portion 208 are coplanar with each other and border at least a portion of the product display opening 210, as compared to the container 600 depicted in FIG. 6 (discussed further below) where the first and second side portions 204", 206" and the display portion 208" are coplanar with each other, and in combination with side panels 258, 259 adhered to the rear surface of first and second side portions 204", 206", respectively, border at least a portion of the product display opening 210. In an embodiment, a maximum height of the display portion 208 is no more than half a maximum height of the first panel 202 or the container 100, or alternatively is no more than one third a maximum height of the first panel 202 or the container 100, or further alternatively is no more than one quarter a maximum height of the first panel 202 or the container 100. The first panel 202 further includes a first relief feature 212 disposed between the display portion 208 and the first side portion 204, and a second relief feature 214 disposed between the display portion 208 and the second side portion 206, where the first and second relief features 212, 214 are also formed by an absence of material of the first panel 202. In an embodiment, the first and second relief features 212, 214 serve as stress relief features to control creasing or distortion of the display portion 208 of container 100 when one such container 100 is stacked on top of another. While an embodiment disclosed herein depicts the relief features 212, 214 as U-shaped relief features, it will be appreciated by one of ordinary skill in the art that other shaped relief features may be suitable for a purpose disclosed herein, and that such other shaped relief features are contemplated and are considered to fall within the scope of the invention disclosed herein. As can be seen in both FIGS. 1 and 2, an edge 216 of the first side portion 204, a u-shaped edge 218 of the first relief feature 212, an edge 220 of the display portion 208, a u-shaped edge 222 of the second relief feature 214, and an edge 224 of the second side portion 206, form a continuous edge that at least partially defines a periphery of the product display opening 210. As such and in an embodiment, the absences of material of the first panel 202 that forms the combination of the product display opening 210, the first relief feature 212, and the second relief feature 214, may be viewed as a single absence of material of the first panel 202. However, it is contemplated that a container having an advantage as disclosed herein may be achieved by forming absences of material of the first panel 202 to form the product display opening 210, the first relief feature 212, and the second relief feature 214. As will be appreciated by one of ordinary skill in the art, the presence of a bridge portion (not shown) of the first panel 202 configured to extend across the upper regions of the first and second side portions 204, 206 would provide another edge that would further define the periphery of the product display opening 210. Hence, edges 216, 218, 220, 222 and 224 as herein disclosed at least partially define the periphery of the product display opening 210. In an embodiment, the width, w, of the first relief feature 212, the second relief feature 214, or both the first and the second relief features, 212, 214, may have a dimension equal to or greater than the caliper thickness, e, of the first panel 202 and equal to or less than ¾ inch, or may have a dimension equal to or greater than ⅛ inch and equal to or less than ¾ inch. In an embodiment, the material of the flat blank 400 is corrugated fiber board having a thickness, e, referred to herein as the caliper of the corrugated fiber board, and as depicted in FIG. 2, the flute direction F of the corrugated fiber board is arranged so that the flutes of at least the first panel 202 are oriented parallel with the z-axis.

Figure 3A:
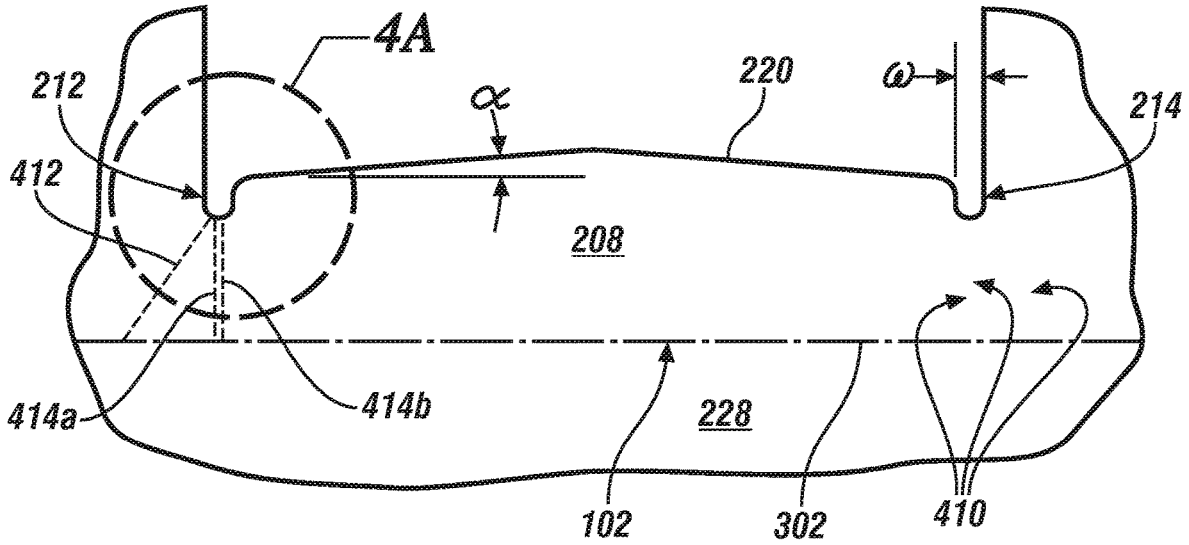
FIG. 3A depicts a detail 3A portion of the flat blank of FIG. 2, in accordance with an embodiment.
Figure 3B:
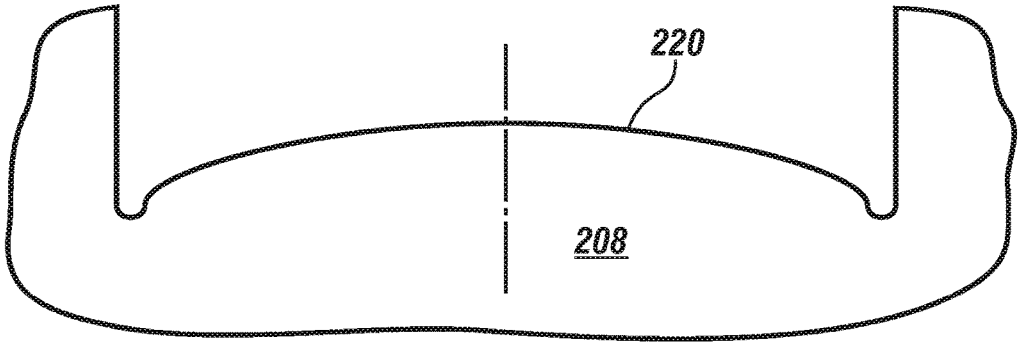
FIGS. 3B-3H depict alternative profiles of that depicted in FIG. 3A, in accordance with an embodiment.
Figure 3C:
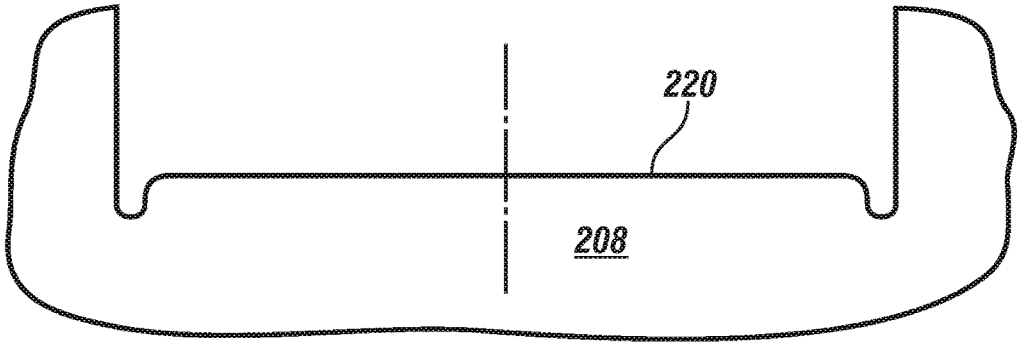
Figure 3D:
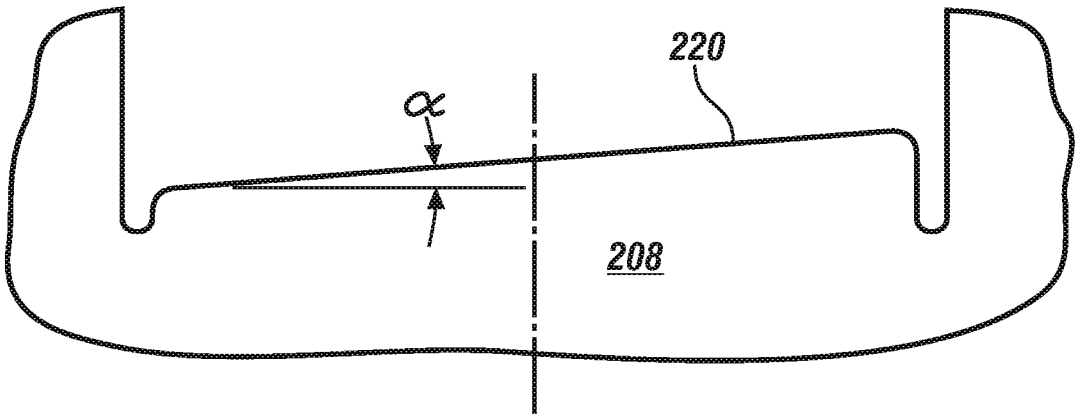
Figure 3E:
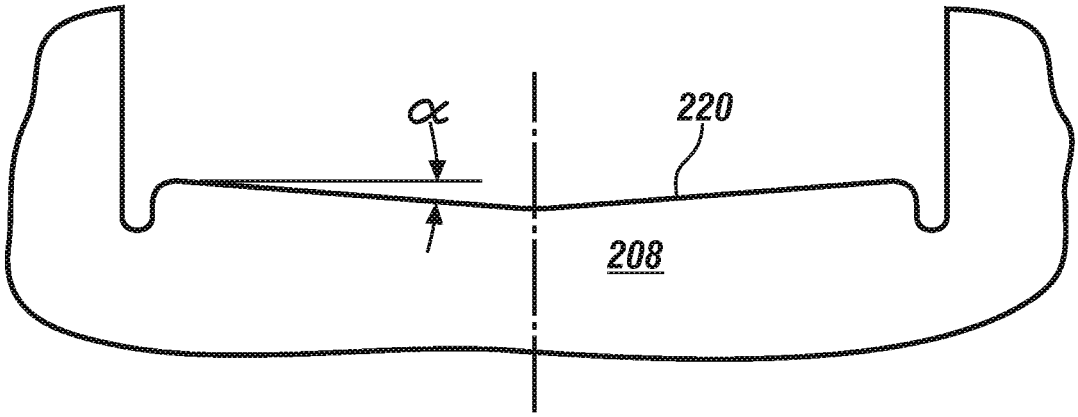
Figure 3F:
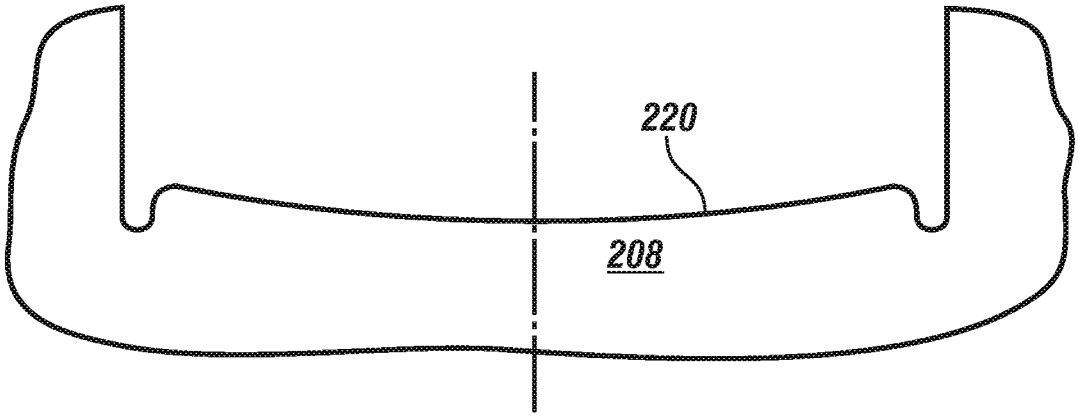
Figure 3G:
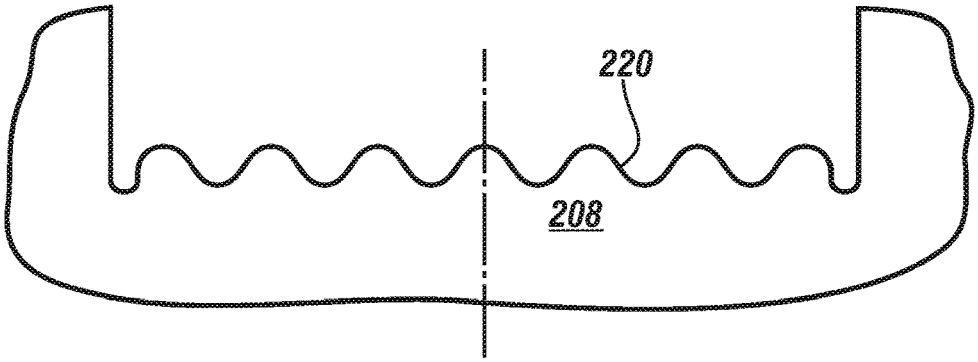
Figure 3H:
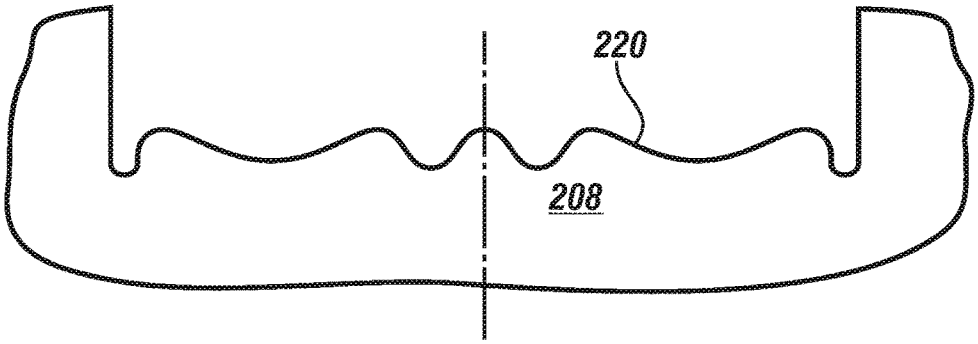

Reference is now made to FIGS. 2 and 3A-3H, where FIG. 3A depicts detail 3A of FIG. 2, and FIGS. 3B-3H depict alternative embodiments to that depicted in FIG. 3A. As illustrated, the edge 220 of the display portion 208 may have the form of one of many profiles. For example, the edge 220 may have the form of: an inverted V-form shape (FIG. 3A for example); a convex shape (FIG. 3B for example); a linear and horizontal edge (FIG. 3C for example); a linear and non-horizontal edge (FIG. 3D for example), which may have a positive slope to the right as depicted in FIG. 3D, or a negative slope to the right; a V-form shape (FIG. 3E for example); a concave shape (FIG. 3F for example); a cyclical undulating shape (FIG. 3G for example); or, a non-cyclical undulating shape (FIG. 3H for example). In an embodiment where the edge 220 has an inverted V-form, a linear non-horizontal edge, or a V-form shape, an angle $\alpha$ of the edge 200 may be equal to or greater than 2 degrees and equal to or less than 7 degrees and may be on the order of about 4½ degrees. However, it is contemplated that other values for angle $\alpha$ may be equally suitable for a purpose disclosed herein. While only a few profile forms for the edge 220 of the display portion 208 are illustrated herein, it will be appreciated that other profile forms suitable for a purpose disclosed herein are possible and too many to list and illustrate exhaustively. As such, Applicant considers any profile form for the edge 220 of the display portion 208 suitable for a purpose disclosed herein as being contemplated herein and considered to fall within the ambit of the appended claims.

Figure 4A:
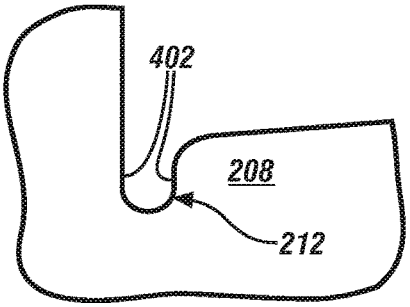
FIG. 4A depicts a detail 4A portion of the partial flat blank of FIG. 3A, in accordance with an embodiment.
Figure 4B:
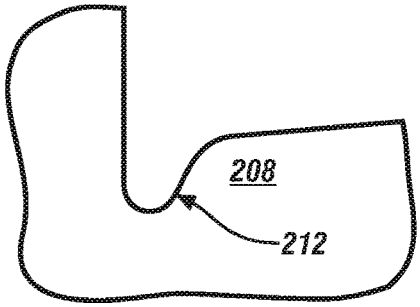
FIGS. 4B-4C depict alternative profiles to that depicted in FIG. 4A, in accordance with an embodiment.
Figure 4C:
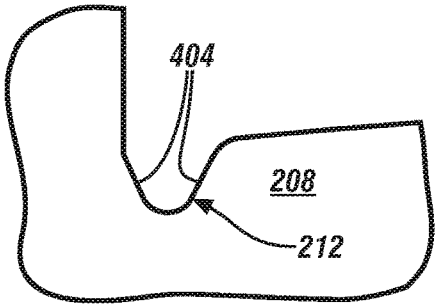

Reference is now made to FIGS. 2, 3A and 4A-4C, where FIG. 4A depicts detail 4A of FIG. 3A, and FIGS. 4B and 4C depict alternative embodiments to that depicted in FIG. 4A. As illustrated, the first and second relief features 212, 214 (while only the first relief feature 212 is depicted in FIGS. 4A-4C, it will be appreciated that a description of one relief feature may be equally applicable to a description of the other relief feature) may take on many forms. For example, the first relief feature 212, the second relief feature 214, or both the first and the second relief feature 212, 214 may have the form of: a curved cutout (FIGS. 4A-4C for example); a semi-circular cutout (FIG. 4B for example); a slotted cutout (FIG. 4A for example); a slotted cutout with a curved end (FIG. 4A for example); a slotted cutout with a semi-circular end (FIG. 4B for example); a slotted cutout with parallel sides 402 (FIG. 4A for example); a slotted cutout with non-parallel sides 404 (FIG. 4C for example); a slotted cutout with at least one side disposed parallel to the z-axis when in a folded state (FIG. 4A for example); a slotted cutout with at least one side disposed non-parallel to the z-axis when in a folded state (FIG. 4C for example); any combination of the foregoing cutouts; or, any combination of one or more of the foregoing cutouts. While only a few forms of cutouts for the first and second relief features 212, 214 are illustrated herein, it will be appreciated that other forms of cutout suitable for a purpose disclosed herein are possible and too many to list and illustrate exhaustively. As such, Applicant considers any form of cutout for the first and second relief features 212, 214 suitable for a purpose disclosed herein as being contemplated herein and considered to fall within the ambit of the appended claims.

In an embodiment and with reference back to FIGS. 1 and 2, the plurality of planar panels 200 further includes a second panel 228 and a third panel 238, where the second panel 228 is configured to be perpendicular to the z-axis when in the folded state, and the third panel 238 is configured to be parallel to the z-axis when in the folded state. The second panel 228, forms a contiguity with the first panel 202 with a first fold line 302 disposed therebetween, and the third panel 238 forms a contiguity with the second panel 228 with a second fold line 304 disposed therebetween. By comparing FIGS. 1 and 2, it will be appreciated that the first and second fold lines 302, 304 serve to form the bottom edges 102, 104 of the container 100 (see FIG. 1 for example) when in the folded state.

With reference now to the flat blank 400 depicted in FIG. 2 in combination with FIGS. 1 and 3A (and best seen with specific reference to FIG. 3A), an embodiment of the flat blank 400 and container 100 may optionally further include one or more surface disturbances 410 in the first panel 202 that may be formed by: a score, a crease, a perforation, or any combination of the foregoing score, crease and perforation, formed in the first panel 202 and extending away from the first relief feature 212, the second relief feature 214, or both the first and the second relief feature 212, 214, toward the first fold line 302 disposed between the first panel 202 and the adjacent second panel 228. As depicted in FIG. 3A, the surface disturbances 410 may take on many forms. For example, the surface disturbances 410: may be an angularly oriented linear surface disturbance 412 from each respective first and second relief feature 212, 214 outwardly sideways towards a respective portion of the first fold line 302; or, may be a vertically oriented linear surface disturbance 414 that extends parallel to the z-axis, when in the folded state, from each respective first and second relief feature 212, 214 vertically downward towards the first fold line 302. In and embodiment, the vertically oriented surface disturbance 414 may comprise at least two vertically oriented surface disturbances 414*a*, 414*b* disposed parallel to each other. In an embodiment, the surface disturbances 410, and particularly the angularly oriented linear surface disturbances 412, terminate proximate the first fold line 302 at a distance D away from a cut edge corner 240 of the flat blank 400 that forms a lower corner of the first panel 202. In an embodiment, the distance D is equal to or greater than one inch and equal to or less than three inches and may be on the order of about 2⅛ inches.

Figure 5:
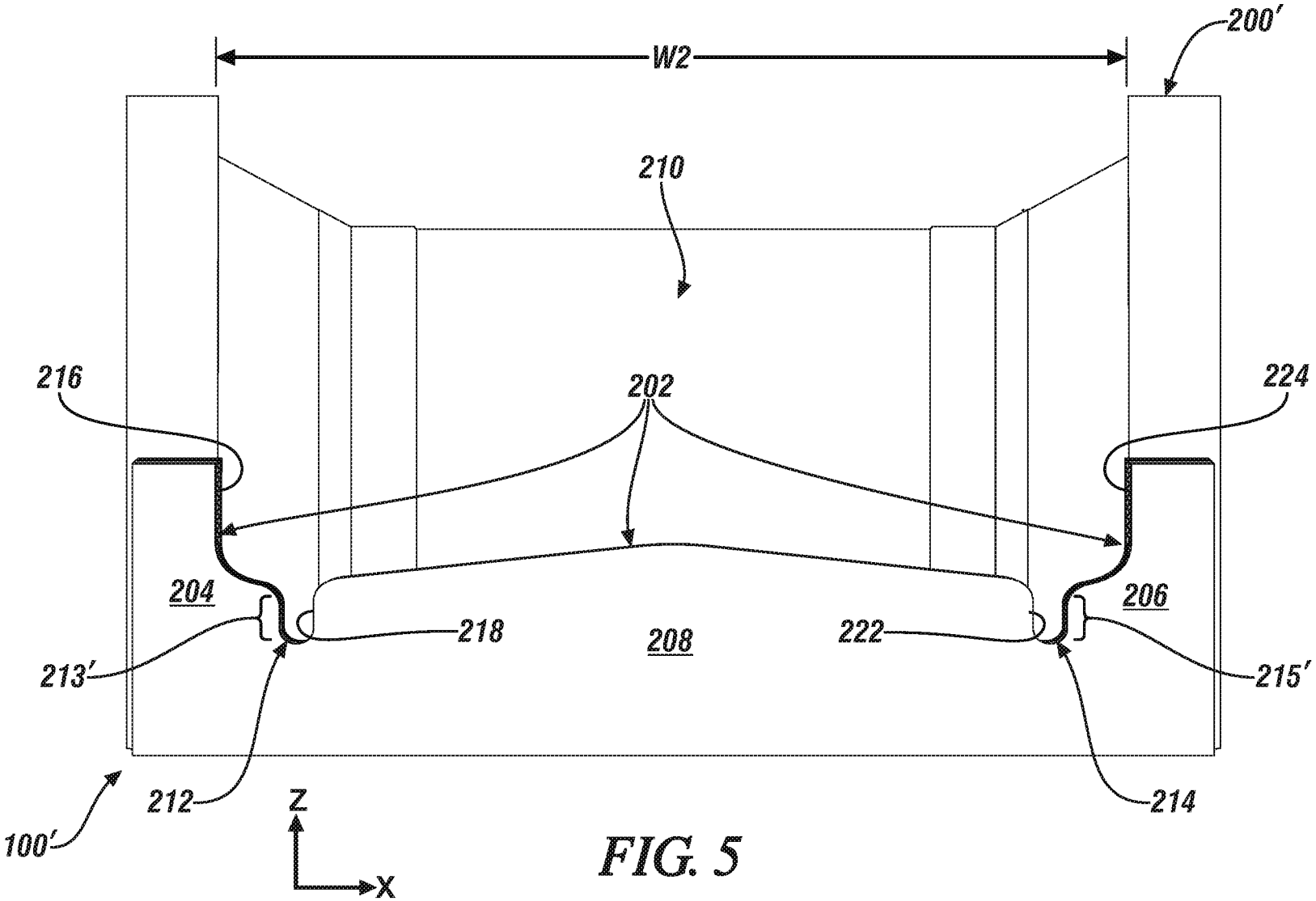
FIG. 5 depicts an alternative arrangement of the first and second relief features, in accordance with an embodiment.

Reference is now made to FIG. 5, which depicts an alternative arrangement for the first and second relief features 212, 214 relative to the overall width W2 of the product display opening 210, as compared to those similar features depicted in FIG. 1 through FIG. 4C. As depicted in FIG. 1, the edge 216 of the first side portion 204 is linear and oriented parallel with the z-axis and a first linear portion 213 of the u-shaped edge 218 of the first relief feature 212 are contiguous with each other, and the edge 224 of the second side portion 206 is linear and oriented parallel with the z-axis and a first linear portion 215 of the u-shaped edge 222 of the second relief feature 214 are contiguous with each other. Alternatively, and as depicted in FIG. 5, the edge 216 of the first side portion 204 and a first linear portion 213' of the u-shaped edge 218 of the first relief feature 212 are not contiguous with each other, and the edge 224 of the second side portion 206 and a first linear portion 215' of the u-shaped edge 222 of the second relief feature 214 are not contiguous with each other.

As depicted in FIG. 5 and relative to the product display opening 210, the plurality of planar panels 200' include a first panel 202 disposed parallel to the z-axis (when the panels 200' are in a folded state to form the container 100'), and where similar to the embodiment depicted in FIG. 1, the first panel 202 includes a first side portion 204, a second side portion 206, and a display portion 208 disposed between the first and second side portions 204, 206. Further relative to the product display opening 210 of the embodiment depicted in FIG. 5, the first linear portion 213' of the u-shaped edge 218 of the first relief feature 212 is disposed offset and inboard of the edge 216 of the first side portion 204, and the first linear portion 215' of the u-shaped edge 222 of the second relief feature 214 is disposed offset and inboard of the edge 224 of the second side portion 206. In an embodiment, the first linear portion 213' of the u-shaped edge 218 of the first relief feature 212 is disposed inboard of the edge 216 of the first side portion 204 by at least 0.125 inches, or alternatively by at least 0.25 inches, or further alternatively by at least 0.5 inches, and the first linear portion 215' of the edge 222 of the second relief feature 214 is disposed inboard of the edge 224 of the second side portion 206 by at least 0.125 inches, or alternatively by at least 0.25 inches, or further alternatively by at least 0.5 inches. Stated another way, the first linear portion 213' of the u-shaped edge 218 of the first relief feature 212 is disposed inboard of the edge 216 of the first side portion 204 by at least 2% of the overall width opening W2 of the product display opening 210, or alternatively by at least 3% of the overall width opening W2 of the product display opening 201, or further alternatively by at least 5% of the overall width opening W2 of the product display opening 210, and the first linear portion 215' of the edge 222 of the second relief feature 214 is disposed inboard of the linear portion 224' of the edge 224 of the second side portion 206 by at least 2% of the overall width opening W2 of the product display opening 210, or alternatively by at least 3% of the overall width opening W2 of the product display opening 201, or further alternatively by at least 5% of the overall width opening W2 of the product display opening 210. Comparing the display portion 208, the first and second side portions 204, 206, and the relief features 212, 214 of FIG. 5 with similarly denoted features of FIG. 1, it will be appreciated that the relief features of one embodiment of container 100 (FIG. 5 for example) may be interchanged with another embodiment of container 100 (FIG. 1 for example) while staying within the scope of an invention disclosed here.

Figure 6:
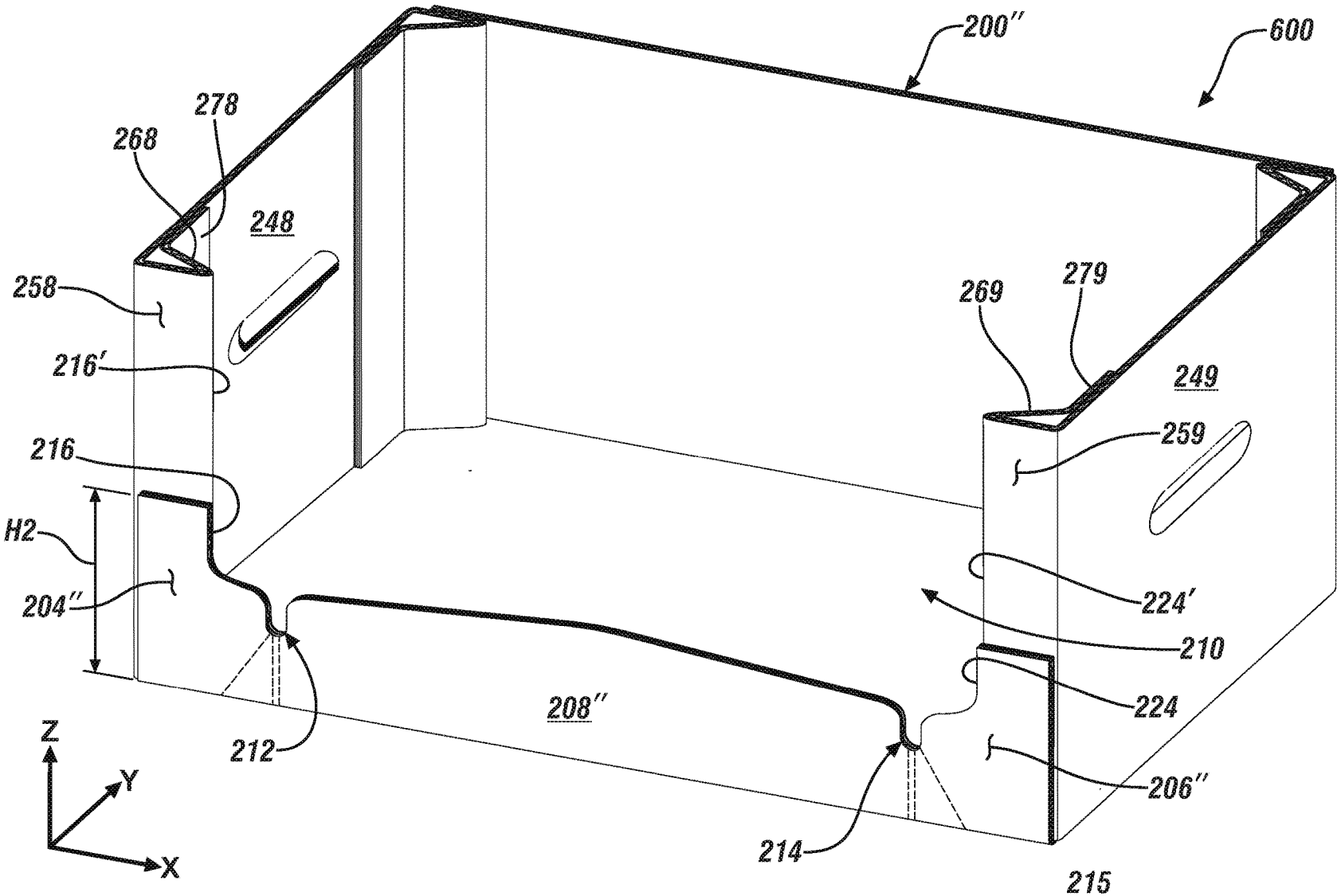
FIG. 6 depicts a rotated isometric view of an alternative container having first and second relief features, in accordance with an embodiment.
Figure 7:
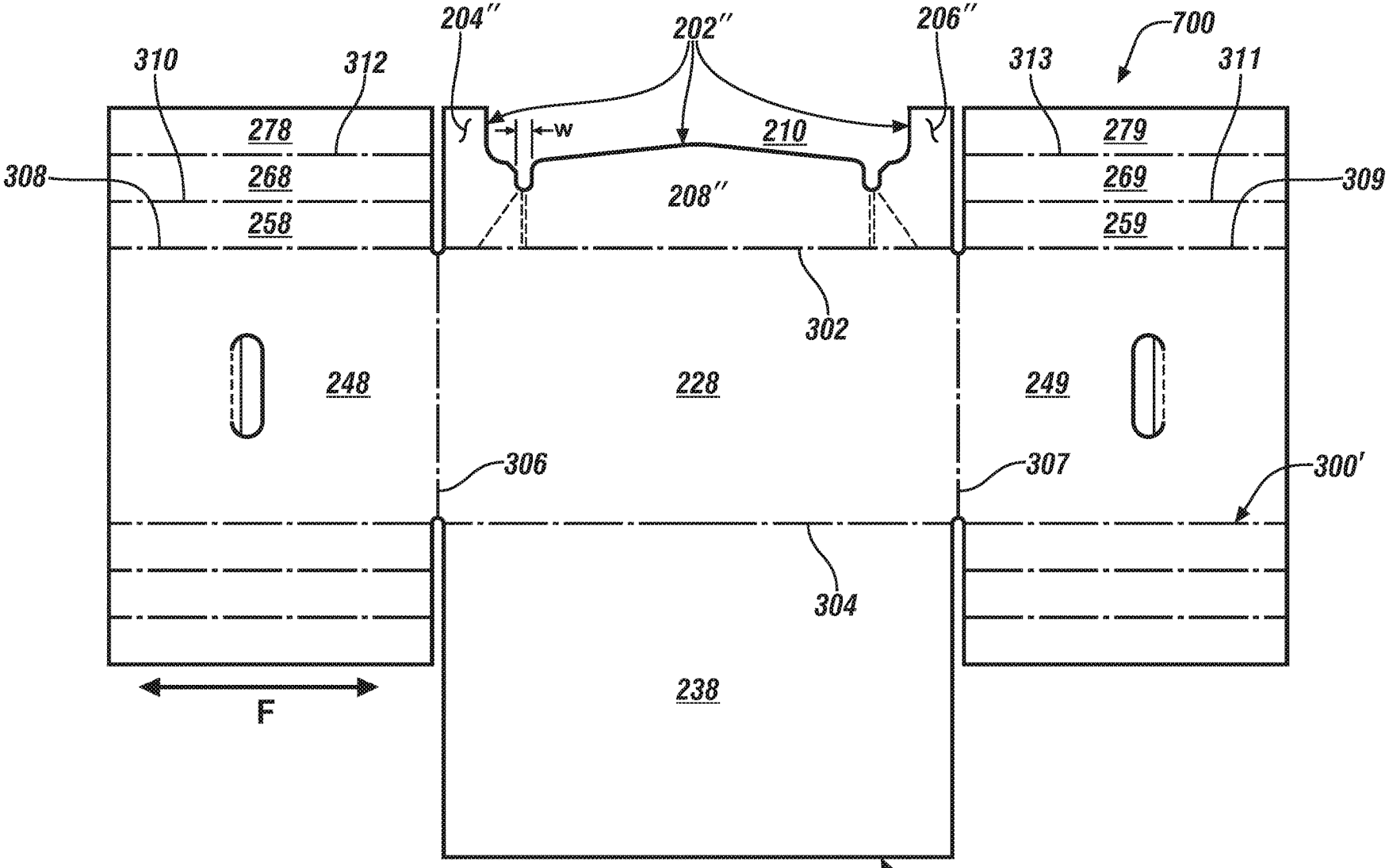
FIG. 7 depicts a flat blank suitable for making at least a portion of the container of FIG. 6, in accordance with an embodiment.

Reference is now made to FIGS. 6 and 7, where FIG. 6 depicts a rotated isometric view of an example embodiment of an alternative container 600 in accordance with an embodiment disclosed herein, and FIG. 7 depicts an alternative flat blank 700 suitable for forming at least a portion of the container 600 of FIG. 6, where a plurality of alternative panels 200" are foldable via a plurality of alternative fold lines 300' to form the alternative container 600. Reference will now be made to FIGS. 6 and 7 collectively. By comparing FIGS. 6 and 7 to FIGS. 1 and 2, it will be appreciated that the container 600 is similar to the container 100 with respect to providing a display panel 208 and a product display opening 210, but with some subtle differences that will now be described, where like features are numbered alike.

As depicted in FIGS. 6 and 7, an embodiment of the plurality of panels 200" include a fourth and a fifth panel 248, 258, respectively, where both the fourth panel 248 and the fifth panel 258 are oriented parallel with the z-axis when the panels 200" are folded to form the container 600, where the fourth panel 248 forms a contiguity with the second panel 228 with a third fold line 306 disposed therebetween, where the fifth panel 258 forms a contiguity with the fourth panel 248 with a fourth fold line 308 disposed therebetween, and where a rear surface of the first panel 208 and a portion of a front surface of the fifth panel 258 are adhered to each other (best seen with reference to FIG. 6).

Figure 8:
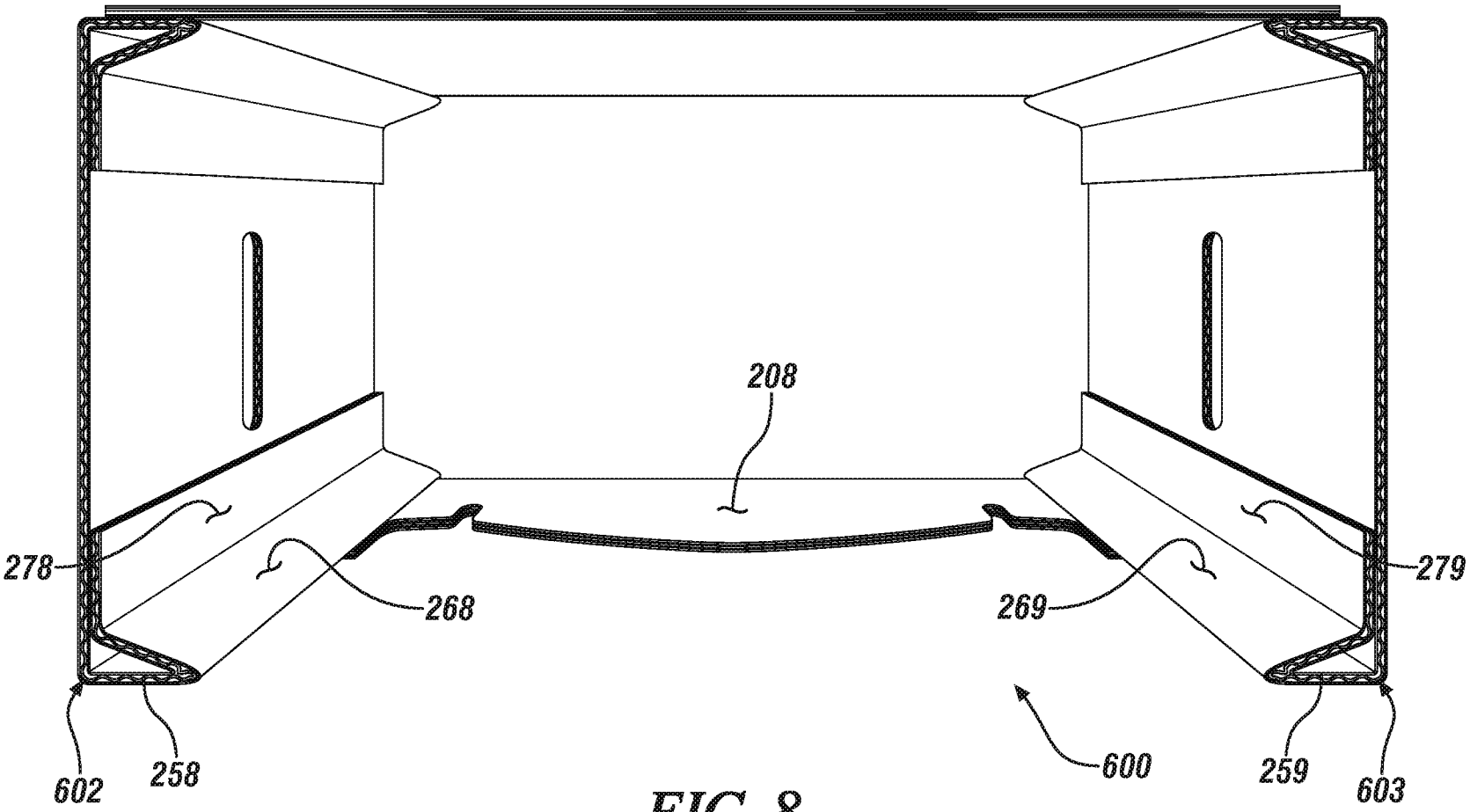
FIG. 8 depicts a top down perspective view of the container of FIG. 6, in accordance with an embodiment.

Furthermore, an embodiment of the plurality of panels 200" includes a sixth panel 268 and a seventh panel 278, where both the sixth panel 268 and the seventh panel 278 are oriented parallel with the z-axis when the panels 200" are folded to form the container 600, where the sixth panel 268 forms a contiguity with the fifth panel 258 with a fifth fold line 310 disposed therebetween, where the seventh panel 278 forms a contiguity with the sixth panel 268 with a sixth fold line 312 disposed therebetween, and where the fourth 248, the fifth 258, and the sixth 268 panels may form a triangular shaped corner cavity 602, when the panels 200" are folded to form the container 600, as viewed from the plan view of the container 600 depicted in FIG. 8. Alternatively, the fourth 248, the fifth 258, and the sixth 268 panels may not form a triangular shaped corner cavity 602, but instead may be folded flat against each other to form a rigid corner, when the panels 200" are folded to form the container 600.

Similar to the above described fourth, fifth, sixth and seventh panels 248, 258, 268, 278, an embodiment of the plurality of panels 200" include an eighth and a ninth panel 249, 259, respectively, where both the eighth panel 249 and the ninth panel 259 are oriented parallel with the z-axis when the panels 200" are folded to form the container 600, where the eighth panel 249 forms a contiguity with the second panel 228 with a seventh fold line 307 disposed therebetween, where the ninth panel 259 forms a contiguity with the eighth panel 249 with a eighth fold line 309 disposed therebetween, and where a rear surface of the first panel 208 and a portion of a front surface of the ninth panel 259 are adhered to each other. Furthermore, an embodiment of the plurality of panels 200" includes a tenth panel 269 and an eleventh panel 279, where both the tenth panel 269 and the eleventh panel 279 are oriented parallel with the z-axis when the panels 200" are folded to form the container 600, where the tenth panel 269 forms a contiguity with the ninth panel 259 with a ninth fold line 311 disposed therebetween, where the eleventh panel 279 forms a contiguity with the tenth panel 269 with a tenth fold line 313 disposed therebetween, and where the eighth 249, the ninth 259, and the tenth 269 panels form a triangular shaped corner cavity 603, when the panels 200" are folded to form the container 600, as viewed from the perspective plan view of the container 600 depicted in FIG. 8. Alternatively, the eighth 249, the ninth 259, and the tenth 269 panels may not form a triangular shaped corner cavity 603, but instead may be folded flat against each other to form a rigid corner, when the panels 200" are folded to form the container 600.

In an embodiment and with reference to FIG. 6, the fifth panel 258 has an associated folded edge 216' that is disposed in substantial linear alignment with the edge 216 of the first side portion 204, and the ninth panel 259 has an associated folded edge 224' that is disposed in substantial linear alignment with the edge 224 of the second side portion 206, where the folded edges 216', 224' of the corresponding fifth and ninth panels 258, 259 border at least a portion of the product display opening 210. As used herein, the term substantial linear alignment means linear alignment within predefined manufacturing tolerances for the folded container 600.

Comparing the container 600 of FIG. 6 with the container 100 of FIG. 5, it will be appreciated that the same offset relief features 212, 214 as described herein above in connection with the description of FIG. 5 may be employed in containers 100 and 600 formed from different flat blanks 400 and 700, respectively.

In the embodiment depicted in FIG. 1 and as noted herein above, the plurality of panels 200 may be formed from a corrugated material having flutes, where the flutes of at least the first panel 202 are oriented parallel with the z-axis (see flute direction F in FIG. 2). Alternatively, and with reference to FIGS. 6-8, the plurality of panels 200" may be formed from a corrugated material having flutes, where the flutes of at least the first panel 202" are oriented orthogonal to the z-axis (see flute direction F in FIG. 7). In the embodiment depicted in FIGS. 6-8, the first panel 202" is disposed parallel to the z-axis (when the panels 200" are in a folded state to form the container 600), where the first panel 202" includes a first side portion 204", a second side portion 206", and a display portion 208" disposed between the first and second side portions 204", 206". As can be seen by comparing the embodiment of FIG. 6 with the embodiment of FIG. 1, the first and second side portions 204", 206" depicted in FIG. 6 have a height H2 that is less than the height H1 of the first and second side portion 204, 206 depicted in FIG. 1. As will be appreciated by one skilled in the art, the reference hereinabove to a bridge portion (not shown) in reference to the embodiment of FIG. 1, would not apply to the embodiment of FIG. 6, due to the height difference between H1 and H2. In the embodiment depicted in FIGS. 6-8, the width, w (see FIG. 7), of the first relief feature 212, the second relief feature 214, or both the first and the second relief features, 212, 214 (see FIG. 6), may have a dimension equal to or greater than the caliper thickness, e, of the first panel 202" and equal to or less than ¾ inch, or may have a dimension equal to or greater than ⅛ inch and equal to or less than ¾ inch. In an embodiment, the material of the flat blank 700 is corrugated fiber board having a thickness, e, referred to herein as the caliper of the corrugated fiber board, and as depicted in FIG. 7, the flute direction F of the corrugated fiber board is arranged so that the flutes of at least the first panel 202" are oriented orthogonal with the z-axis depicted in FIG. 6.

With reference to all of the foregoing embodiments, it will be appreciated that the first panel (202 in the embodiment of FIG. 2, and 202" in the embodiment of FIG. 7) includes a first side portion (204 in the embodiments of FIGS. 1-2, and 204" in the embodiments of FIGS. 6-7), a second side portion (206 in the embodiments of FIGS. 1-2, and 206" in the embodiments of FIGS. 6-7), and a display portion (208 in the embodiments of FIGS. 1-2, and 208" in the embodiments of FIGS. 6-7) disposed between the respective first and second side portions 204, 204", 206, 206", where the respective first and second side portions 204, 204", 206, 206" and the respective display portion 208, 208" are coplanar and border at least a portion of a product display opening 210, and where the at least a portion of the product display opening 210 and the first and second relief features 212, 214 are formed by an absence of material of the respective first panel 202, 202". In the container 100 depicted in FIG. 1 the first and second side portions 204, 206 extend the entire height H1 of the container 200, while in the container 600 depicted in FIG. 6 the first and second side portions 204", 206" extend a height H2 that is not the entire height of the container 600.

By offsetting the relief features 212, 214 as depicted in FIGS. 5 and 6 and in comparison to FIG. 1, a design advantage was found in that the offset relief features provided additional box compression strength while increasing the product display window, where W2 of FIG. 5 (same for FIG. 6, but not enumerated) is greater than W1 of FIG. 1.

While an embodiment of the container 100 has been disclosed herein having a rectangular shape with an open top, a closed back, and closed sides, it will be appreciated that the scope of the invention is not so limited and encompasses any other shaped container or panel configuration suitable for a purpose disclosed herein, such as a square container, a container having four, five, six, seven, eight or more sides, a container having a closed top, a container having one or more openings at the back, or a container having one or more openings at one or both sides, for example. Any such container alternative to that disclosed herein and being suitable for a purpose disclosed herein and falling within the ambit of the appended claims is considered to be within the scope of an invention disclosed herein.

While an invention has been described herein with reference to example embodiments, it will be understood by those skilled in the art that various changes may be made, and equivalents may be substituted for elements thereof without departing from the scope of the claims. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Additionally, the term "comprising" as used herein does not exclude the possible inclusion of one or more additional features.

What is claimed is:

1. A container, comprising:

a plurality of planar panels integrally arranged with respect to each other and with respect to a set of orthogonal x, y and z axes, the z-axis defining a direction line in which the container is configured to support a stacking load, the plurality of panels being foldable to create the container;

wherein the plurality of planar panels comprise a first panel disposed parallel to the z-axis;

wherein the first panel comprises a first side portion, a second side portion, and a display portion disposed between the first and second side portions, the first and second side portions and the display portion being coplanar and bordering at least a portion of a product display opening;

wherein the first panel further comprises a first relief feature disposed between the display portion and the first side portion, and a second relief feature disposed between the display portion and the second side portion;

wherein the at least a portion of the product display opening and the first and second relief features are formed by an absence of material of the first panel; and further comprising:

a surface disturbance in the first panel, the surface disturbance comprising: a score, a crease, a perforation, or any combination of the foregoing score, crease and perforation, formed in the first panel and extending from the first relief feature, the second relief feature, or corresponding ones of both the first and the second relief feature, toward a bottom edge of the container.

2. The container of claim 1, wherein:

a maximum height of the display portion is no more than half a maximum height of the container.

3. The container of claim 1, wherein:

the absence of material of the first panel that forms in combination the at least a portion of the product display opening, the first relief feature, and the second relief feature, is a single absence of material of the first panel.

4. The container of claim 1, wherein:

an edge of the first side portion, an edge of the first relief feature, an edge of the display portion, an edge of the second relief feature, and an edge of the second side portion, form a continuous edge that at least partially defines a periphery of the at least a portion of the product display opening.

5. The container of claim 1, wherein the first relief feature, the second relief feature, or both the first and the second relief feature comprises:

a curved cutout; a semi-circular cutout; a slotted cutout; a slotted cutout with a curved end; a slotted cutout with a semi-circular end; a slotted cutout with parallel sides; a slotted cutout with non-parallel sides; a slotted cutout with at least one side disposed parallel to the z-axis; a slotted cutout with at least one side disposed non-parallel to the z-axis; any combination of the foregoing cutouts; or, any combination of one or more of the foregoing cutouts.

6. The container of claim 1, wherein:

an edge of the display portion comprises an inverted V-form shape.

7. The container of claim 1, wherein:

an edge of the display portion comprises a convex shape.

8. The container of claim 1, wherein:

an edge of the display portion comprises a linear and horizontal edge.

9. The container of claim 1, wherein:

an edge of the display portion comprises a linear and non-horizontal edge.

10. The container of claim 1, wherein:

an edge of the display portion comprises a V-form shape.

11. The container of claim 1, wherein:

an edge of the display portion comprises a concave shape.

12. The container of claim 1, wherein:

an edge of the display portion comprises a cyclical undulating shape.

13. The container of claim 1, wherein:

an edge of the display portion comprises a non-cyclical undulating shape.

14. The container of claim 1, wherein:

the surface disturbance formed in the first panel extends away from the first relief feature, the second relief feature, or corresponding ones of both the first and the second relief feature, to proximate the bottom edge of the container.

15. The container of claim 1, wherein:

the surface disturbance extends at an angle from each respective first and second relief feature outwardly sideways towards a respective portion of the bottom edge of the container.

16. The container of claim 1, wherein:

the surface disturbance is a vertically oriented surface disturbance that extends parallel to the z-axis from each respective first and second relief feature vertically downward towards the bottom edge of the container.

17. The container of claim 16, wherein:

the vertically oriented surface disturbance comprises at least two of the vertically oriented surface disturbance disposed parallel to each other.

18. The container of claim 4, wherein:

a linear portion of the edge of the first side portion and a first linear portion of the edge of the first relief feature are contiguous with each other; and a linear portion of the edge of the second side portion and a first linear portion of the edge of the second relief feature are contiguous with each other.

19. The container of claim 4, wherein:

a linear portion of the edge of the first side portion and a first linear portion of the edge of the first relief feature are not contiguous with each other; and a linear portion of the edge of the second side portion and a first linear portion of the edge of the second relief feature are not contiguous with each other.

20. The container of claim 19, wherein:

relative to the at least a portion of the product display opening, the first linear portion of the edge of the first relief feature is disposed inboard of the linear portion of the edge of the first side portion; and relative to the at least a portion of the product display opening, the first linear portion of the edge of the second relief feature is disposed inboard of the linear portion of the edge of the second side portion.

21. The container of claim 20, wherein:

the first linear portion of the edge of the first relief feature is disposed inboard of the linear portion of the edge of the first side portion by at least 0.25 inches; and the first linear portion of the edge of the second relief feature is disposed inboard of the linear portion of the edge of the second side portion by at least 0.25 inches.

22. The container of claim 20, wherein:

the first linear portion of the edge of the first relief feature is disposed inboard of the linear portion of the edge of the first side portion by at least 3% of an overall width opening of the at least a portion of the product display opening; and the first linear portion of the edge of the second relief feature is disposed inboard of the linear portion of the edge of the second side portion by at least 3% of an overall width opening of the at least a portion of the product display opening.

23. The container of claim 1, wherein the plurality of planar panels further comprise:

a second and a third panel;

wherein the second panel is oriented perpendicular to the z-axis; and wherein the third panel is oriented parallel to the z-axis.

24. The container of claim 23, wherein:

the second panel forms a contiguity with the first panel with a first fold line disposed therebetween; and the third panel forms a contiguity with the second panel with a second fold line disposed therebetween.

25. The container of claim 1, wherein:

the plurality of planar panels are formed from a corrugated material having flutes, the flutes of the first panel being oriented parallel with the z-axis.

26. The container of claim 1, wherein:

the plurality of planar panels are formed from a corrugated material having flutes, the flutes of the first panel being oriented orthogonal to the z-axis.

27. The container of claim 24, wherein the plurality of planar panels further comprise:

a fourth panel and a fifth panel;

wherein both the fourth panel and the fifth panel are oriented parallel with the z-axis;

wherein the fourth panel forms a contiguity with the second panel with a third fold line disposed therebetween;

wherein the fifth panel forms a contiguity with the fourth panel with a fourth fold line disposed therebetween; and wherein a rear surface of the first panel and a portion of a front surface of the fifth panel are adhered to each other.

28. The container of claim 27, wherein the plurality of planar panels further comprise:

of a sixth panel and a seventh panel;

wherein both the sixth panel and the seventh panel are oriented parallel with the z-axis;

wherein the sixth panel forms a contiguity with the fifth panel with a fifth fold line disposed therebetween;

wherein the seventh panel forms a contiguity with the sixth panel with a sixth fold line disposed therebetween; and wherein the fourth, fifth and sixth panels form a triangular shaped corner cavity as viewed from a plan view of the container.

29. A flat blank, comprising:

a plurality of planar panels integrally arranged with respect to each other with a plurality of fold lines, score lines, perforated lines, or any combination of fold, score, or perforated lines, disposed therebetween, the plurality of panels being foldable to form the container of claim 1; wherein:

the plurality of planar panels are further integrally arranged with respect to a set of orthogonal x, y and z axes, the z-axis defining a direction line in which the container is configured to support a stacking load when the plurality of panels are in a folded state that creates the container;

the plurality of planar panels comprise a first panel configured to be parallel to the z-axis when in the folded state;

the first panel comprises a first side portion, a second side portion, and a display portion disposed between the first and second side portions, the first and second side portions and the display portion being coplanar and bordering at least a portion of a product display opening;

the first panel further comprises a first relief feature disposed between the display portion and the first side portion, and a second relief feature disposed between the display portion and the second side portion; and the first and second relief features are formed by an absence of material of the first panel; and the flat blank further comprising:

a surface disturbance in the first panel, the surface disturbance comprising: a score, a crease, a perforation, or any combination of the foregoing score, crease and perforation, formed in the first panel and extending from the first relief feature, the second relief feature, or both the first and the second relief feature, toward a first fold line disposed between the first panel and an adjacent second panel.

30. The flat blank of claim 29, wherein:

an edge of the first side portion, an edge of the first relief feature, an edge of the display portion, an edge of the second relief feature, and an edge of the second side portion, form a continuous edge that at least partially defines a periphery of the at least a portion of the product display opening.

31. The flat blank of claim 29, wherein the first relief feature, the second relief feature, or both the first and the second relief feature comprises:

a curved cutout; a semi-circular cutout; a slotted cutout; a slotted cutout with a curved end; a slotted cutout with a semi-circular end; a slotted cutout with parallel sides; a slotted cutout with non-parallel sides; a slotted cutout with at least one side disposed parallel to the z-axis when in the folded state; a slotted cutout with at least one side disposed non-parallel to the z-axis when in the folded state; any combination of the foregoing cutouts; or, any combination of one or more of the foregoing cutouts.

32. The flat blank of claim 29, wherein:

an edge of the display portion comprises an inverted V-form shape.

33. The flat blank of claim 29, wherein:

an edge of the display portion comprises a convex shape.

34. The flat blank of claim 29, wherein:

an edge of the display portion comprises a linear and horizontal edge.

35. The flat blank of claim 29, wherein:

an edge of the display portion comprises a linear and non-horizontal edge.

36. The flat blank of claim 29, wherein:

an edge of the display portion comprises a V-form shape.

37. The flat blank of claim 29, wherein:

an edge of the display portion comprises a concave shape.

38. The flat blank of claim 29, wherein:

an edge of the display portion comprises a cyclical undulating shape.

39. The flat blank of claim 29, wherein:

an edge of the display portion comprises a non-cyclical undulating shape.

40. The flat blank of claim 29, wherein:

the surface disturbance extends at an angle from each respective first and second relief feature outwardly sideways towards a respective portion of the first fold line.

41. The flat blank of claim 29, wherein:

the surface disturbance is a vertically oriented surface disturbance that extends parallel to the z-axis, when in the folded state, from each respective first and second relief feature vertically downward towards the first fold line.

42. The flat blank of claim 41, wherein:

the vertically oriented surface disturbance comprises at least two of the vertically oriented surface disturbance disposed parallel to each other.

43. The flat blank of claim 29, wherein the plurality of planar panels further comprise:

a second and a third panel;

wherein the second panel is configured to be perpendicular to the z-axis when in the folded state; and wherein the third panel is configured to be parallel to the z-axis when in the folded state.

44. The flat blank of claim 43, wherein:

the second panel forms a contiguity with the first panel with a first fold line disposed therebetween; and the third panel forms a contiguity with the second panel with a second fold line disposed therebetween.

45. The flat blank of claim 44, wherein the plurality of planar panels further comprise:

a fourth panel and a fifth panel;

wherein both the fourth panel and the fifth panel are configured to be oriented parallel with the z-axis when in the folded state;

wherein the fourth panel forms a contiguity with the second panel with a third fold line disposed therebetween;

wherein the fifth panel forms a contiguity with the fourth panel with a fourth fold line disposed therebetween; and wherein a rear surface of the first panel and a portion of a front surface of the fifth panel are configured to be adhered to each other when in the folded state.

46. The flat blank of claim 45, wherein the plurality of planar panels further comprise:

a sixth panel and a seventh panel;

wherein both the sixth panel and the seventh panel are configured to be oriented parallel with the z-axis when in the folded state;

wherein the sixth panel forms a contiguity with the fifth panel with a fifth fold line disposed therebetween;

wherein the seventh panel forms a contiguity with the sixth panel with a sixth fold line disposed therebetween; and wherein the fourth, fifth and sixth panels are configured to form a triangular shaped corner cavity as viewed from a plan view of the container when in the folded state.

* * * * *